US007246441B1

(12) United States Patent
Collins

(10) Patent No.: US 7,246,441 B1
(45) Date of Patent: Jul. 24, 2007

(54) CONVERTIBLE KNIFE SYSTEM

(76) Inventor: Walter W. Collins, P.O. Box 100, North, SC (US) 29112

( * ) Notice: Subject to any disclaimer, the term of this patent is extended or adjusted under 35 U.S.C. 154(b) by 0 days.

(21) Appl. No.: 10/892,506

(22) Filed: Jul. 15, 2004

(51) Int. Cl.
*B26B 1/04* (2006.01)

(52) U.S. Cl. ..... 30/160; 30/159

(58) Field of Classification Search ..... 30/158, 30/159, 160, 161
See application file for complete search history.

(56) References Cited

U.S. PATENT DOCUMENTS

| | | | | |
|---|---|---|---|---|
| 698,080 | A | 4/1902 | Treas | |
| 1,603,914 | A | 1/1926 | Hermann | |
| 5,095,624 | A | 3/1992 | Ennis | |
| 5,769,094 | A * | 6/1998 | Jenkins et al. | 30/161 |
| D397,282 | S | 8/1998 | Derkatz | |
| 5,815,927 | A | 10/1998 | Collins | |
| 5,819,414 | A | 10/1998 | Marifone | |
| 6,145,202 | A | 11/2000 | Onion | |
| 6,397,477 | B1 | 6/2002 | Collins | |
| 2003/0070299 | A1 | 4/2003 | Frazer | |

* cited by examiner

*Primary Examiner*—Hwei-Siu Payer
(74) *Attorney, Agent, or Firm*—Leatherwood Walker Todd & Mann; Thomas W. Epting

(57) ABSTRACT

An automatic folding knife having a sear provided on a pivoting blade, and an engagement member, configured for upward movement, for selectively engaging the sear. The engagement member extends generally to the exterior of each side portion of the handle. A spring-biased cable biases the blade towards the extended position, and the engagement member is configured for engaging the sear upon the blade being in the retracted position. The blade is configured to automatically pivot from the retracted position to the extended position upon the engagement member being lifted upwardly, and the engagement member also automatically locks the blade in the extended position. The knife can readily be converted to an assisted opening knife having in significant part the components of the automatic knife.

2 Claims, 5 Drawing Sheets

CONVERTIBLE KNIFE SYSTEM

BACKGROUND OF THE INVENTION

This invention relates generally to a folding knife system which can be produced having a folding blade which is manually opened, which has assisted opening, and which has automatic opening from a closed position.

Folding knives are available in at least three varieties. Traditional folding knives have a blade pivotally mounted to a handle, and the handle includes a blade cavity. The blade is movable from a closed, or folded position, generally within the cavity, to an extended, or operable, position, extending outwardly from the handle. It should be noted here that certain folding knives do not have a blade cavity. Instead, the blade, when in the folded position, generally lies along side one or more sides of the handle.

Once the blade is in the extended, or operable position, it may be manually locked in that position by the user, or it may automatically be locked by an automatic locking feature. Many knives, however, lack a locking feature, and the blade, when in the extended position, is held in that position, but can be overcome by the user simply exerting a downward force on the top of the blade in order to move the blade from the extended to the retracted, or folded, position.

Other folding knives are known as assisted-opening knives, and generally require the user to initiate movement of the blade from the folded position towards the extended position, and at a certain point, the blade continues from that point on under its own power. Once in the extended position, the blade may either be locked manually, automatically, or remain unlocked.

A third type of folding knife is known as an automatic knife which requires the user to manipulate a blade release mechanism, which then causes the blade to be propelled, generally under the force of a spring or elastic member, to the extended position.

SUMMARY OF THE INVENTION

Generally, one aspect of the present invention includes a method of converting an automatic opening knife to an assisted opening knife, and includes providing a handle having a back portion, a first exterior side portion, and a second exterior side portion generally opposite the first exterior side portion. A blade is pivotally connected to the handle is for pivoting about a pivot axis between an extended position and a retracted position with respect to the handle, and the blade includes a sear.

The method further includes providing an engagement member configured for upward movement with respect to the back portion of the handle and for selectively engaging the sear, the engagement member extending generally from the first exterior side portion of the handle to the second exterior side portion of the handle and configured for engaging the sear upon the blade being in the retracted position. A cable is provided and is connected to the blade, and a spring is connected to the cable and to the handle and is configured to bias the blade towards the extended position.

The method includes configuring the blade to automatically pivot from the retracted position to the extended position upon the engagement member being lifted upwardly from the back portion of the handle and disengaged with the sear, and after the configuring of the blade, the method includes removing the sear and providing a guide member generally coaxial with the pivot axis of the blade and configured to guide the cable to a position between the pivot axis of the blade and the blade cavity opening of the handle upon the blade being in the retracted position.

The guide member is configured to guide the cable to a position between the pivot axis of the blade and the back of the handle upon the blade being in the extended position, resulting in an assisted opening knife.

The present invention also includes a method of converting an assisted opening knife to an automatic knife and an automatic folding knife.

The automatic folding knife includes a handle having a back portion, a first exterior side portion, and a second exterior side portion generally opposite the first exterior side portion, and a blade pivotally connected to the handle for pivoting between an extended position and a retracted position with respect to the handle. An engagement surface is provided on the blade, and an engagement member is provided configured for upward movement with respect to the back portion of the handle and for selectively engaging the engagement surface of the blade, the engagement member extends generally from the first exterior side portion of the handle to the second exterior side portion of the handle.

Means for biasing the blade towards the extended position are provided, and the engagement member is configured for engaging the engagement surface of the blade upon the blade being in the retracted position.

The blade is configured to automatically pivot from the retracted position to the extended position upon the engagement member being lifted upwardly from the back portion of the handle and disengaged with the engagement surface. A biasing member is included for biasing the engagement member towards the blade, and the blade and engagement member are configured such that the engagement member automatically locks the blade in the extended position.

The present invention also includes an assisted opening knife having in significant part the components of the automatic knife, and, in one preferred embodiment, may include an elongated flexible member connected to the blade, the flexible being connected to the blade and to a biasing member, which, in turn, is connected to the handle. A guide member is also provided which is configured to guide the flexible member to a position between the pivot axis of the blade and the blade cavity opening of the handle upon the blade being in the retracted position, and, also, to guide the flexible member to a position between the pivot axis of the blade and the back of the handle upon the blade being in the extended position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figures 1, 2:
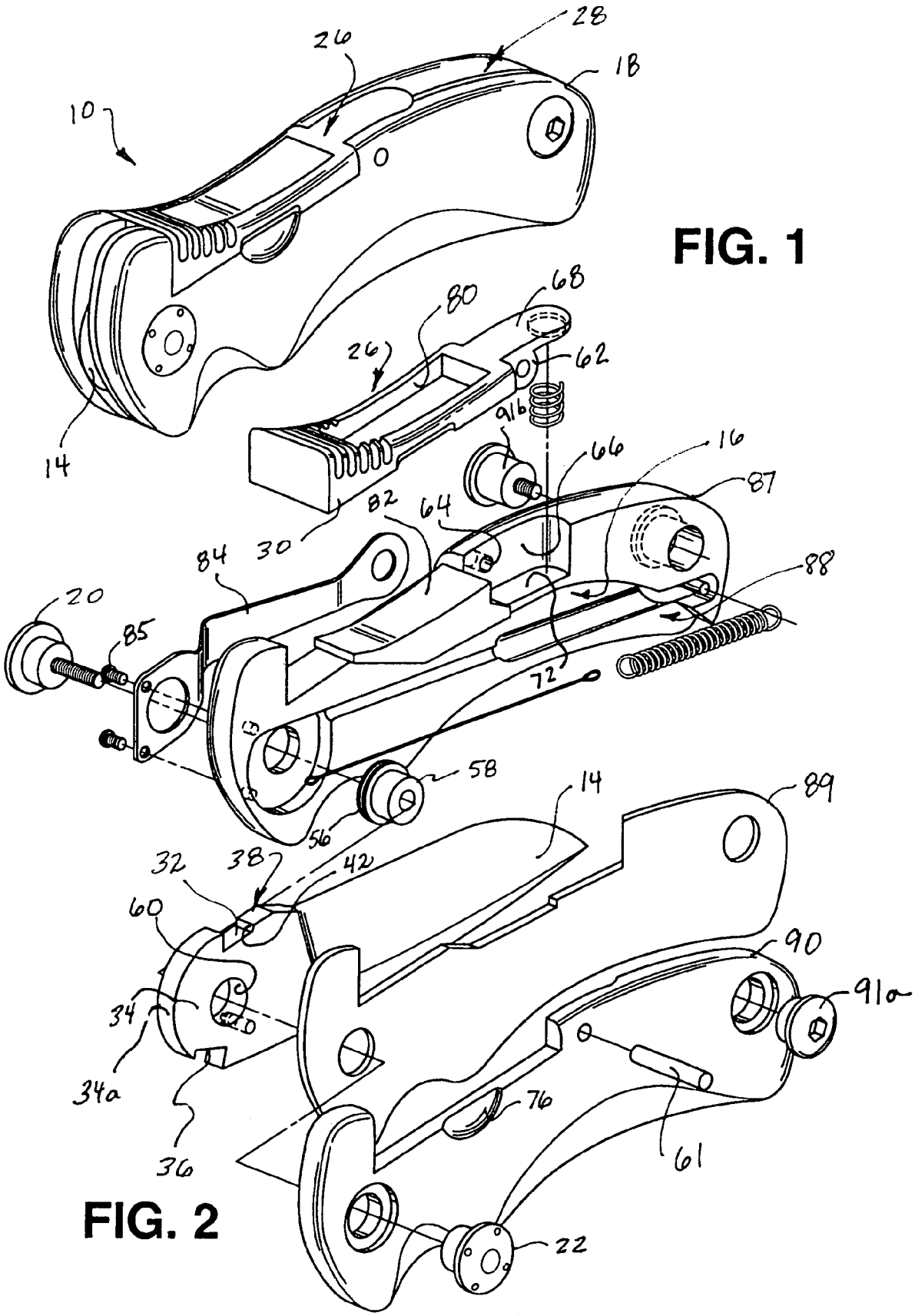
FIG. 1 is a perspective view of an automatic knife constructed in accordance with the present invention, having a blade in a retracted position.
FIG. 2 is an exploded view of the knife shown in FIG. 1.

The accompanying drawings and the description which follows set forth this invention in its preferred embodiment. However, it is contemplated that persons generally familiar with manually-opened, assisted-opened, and automatic folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, automatic-opening, manual-opening, and assisted-opening folding knife systems of the present invention are indicated generally in the figures by referencing characters 10, 100, and 200, respectively.

Figure 3A:
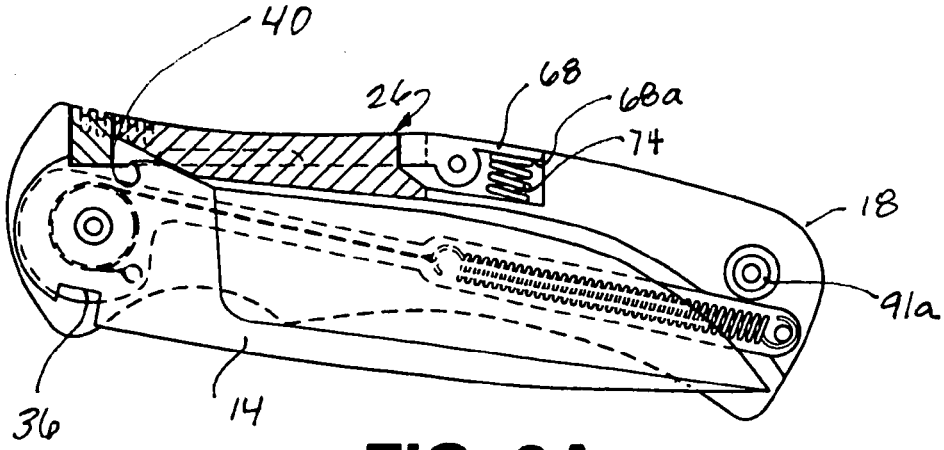
FIG. 3A is a sectional view of the knife shown in FIG. 1, with the blade being in the closed position.
Figure 3B:
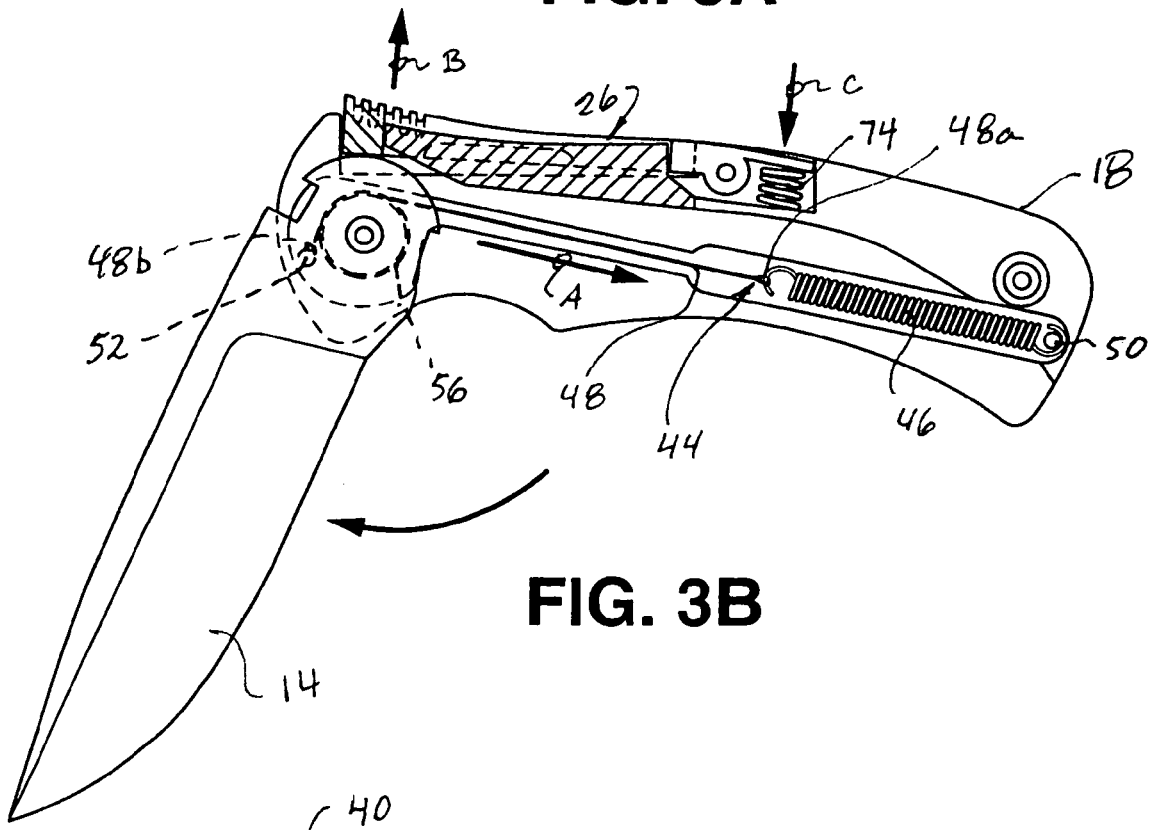
FIG. 3B is a sectional view of the knife shown in FIG. 1, with the blade being in at an intermediate position between the retracted position and the extended, open, or operable position.
Figure 3C:
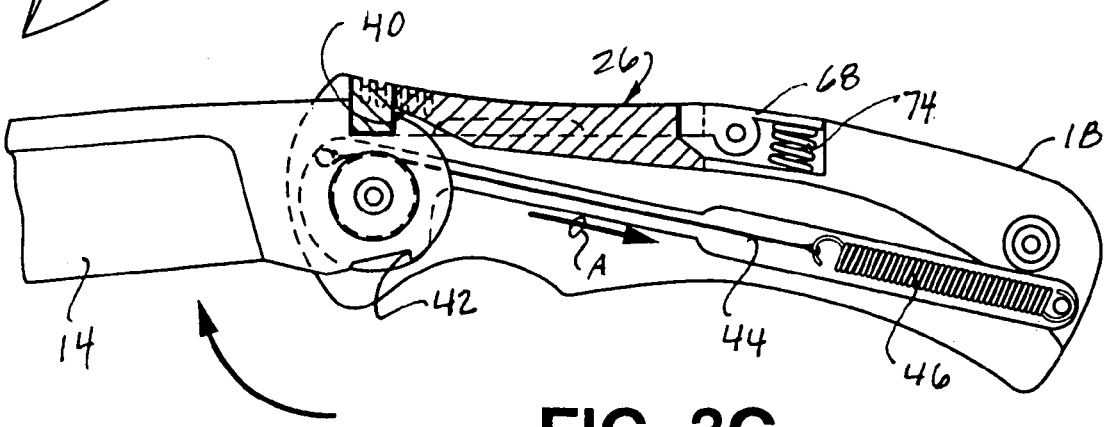
FIG. 3C is a sectional view of the knife shown in FIG. 1, with the blade in the extended position.
Figure 4A:
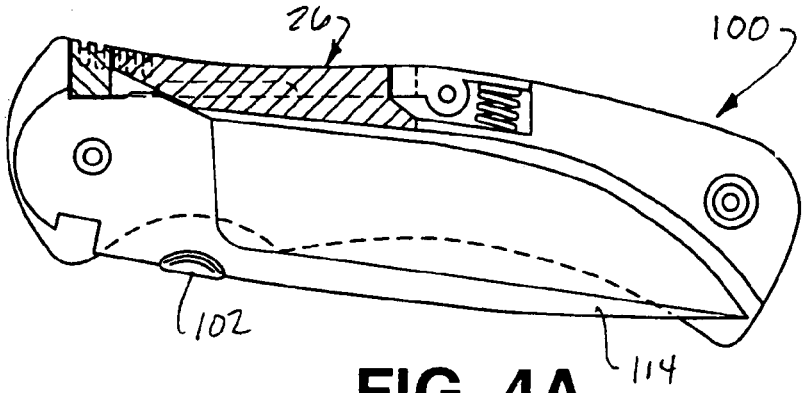
FIG. 4A is a sectional view of an alternate embodiment of a knife constructed in accordance with the present invention, having a blade which is manually moved from the retracted position shown in FIG. 4A, to the extended position, shown in FIG. 4C.
Figure 4B:
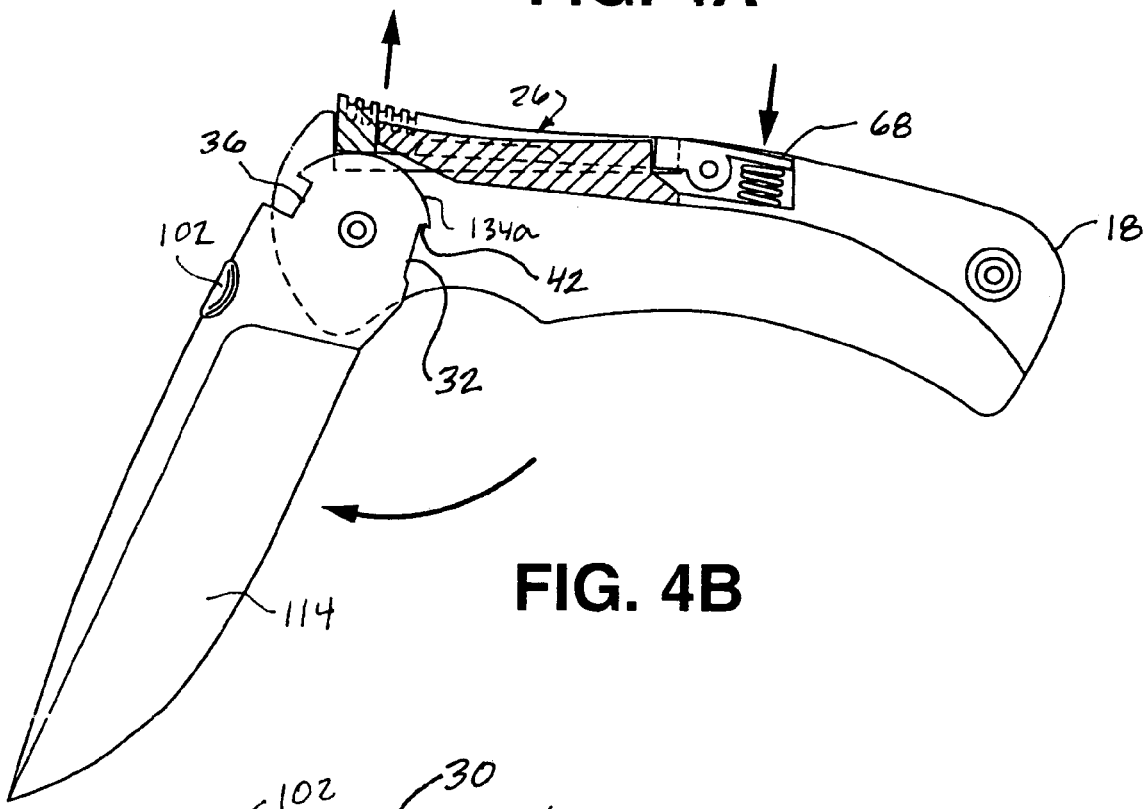
FIG. 4B is a sectional view of the knife shown in FIG. 4A, with the blade in an intermediate position between the retracted and extended positions.
Figure 4C:
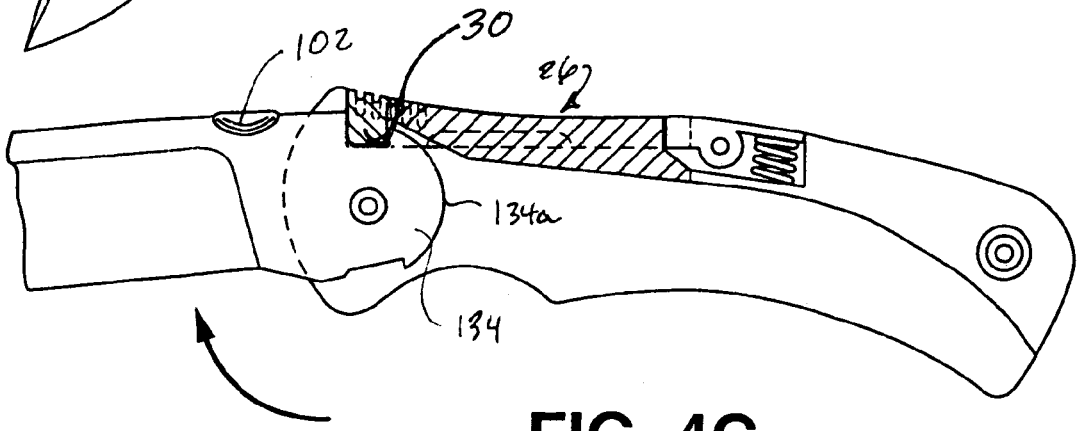
FIG. 4C is a sectional view of the knife shown in FIG. 4A, with the blade shown in the extended position.
Figure 5A:
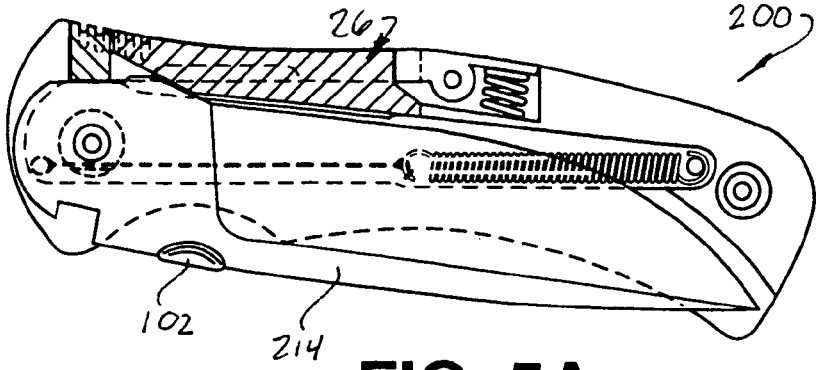
FIG. 5A is a sectional view of an alternate embodiment of a knife constructed in accordance with the present invention, having assisted opening of the blade from the retracted position shown in FIG. 5A to the extended position shown in FIG. 5C.
Figure 5B:
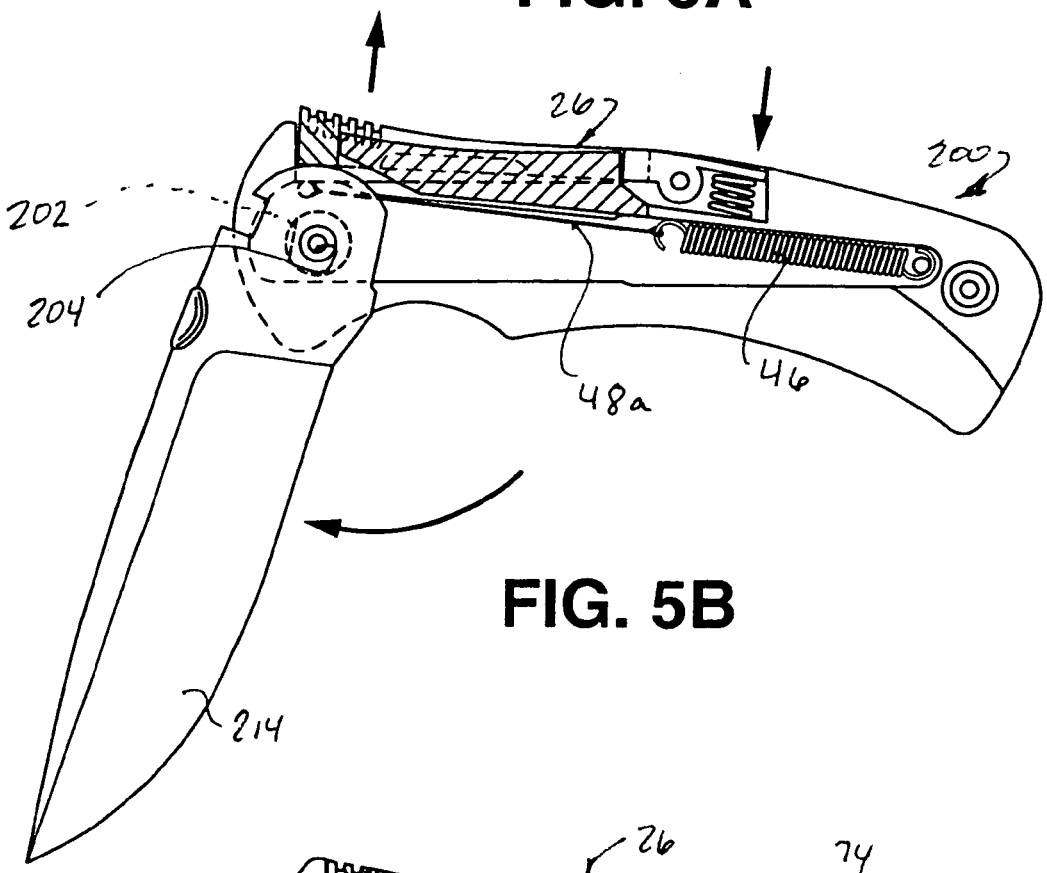
FIG. 5B is a sectional view of the knife shown in FIG. 5A, with the blade in an intermediate position between the retracted and extended positions.
Figure 5C:
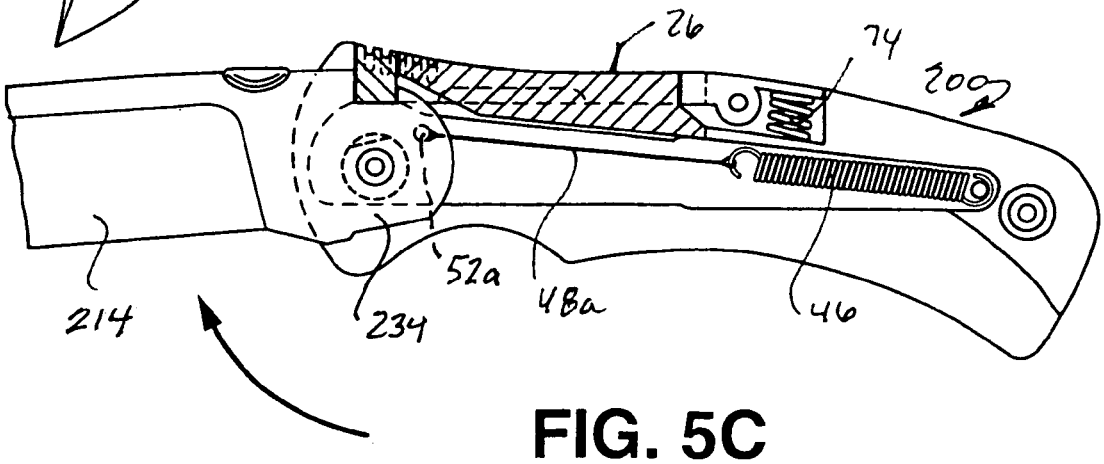
FIG. 5C is a sectional view of the knife shown in FIG. 5A, with the blade shown in the extended position.

Briefly, an automatic version, generally 10, of a knife constructed in accordance with the present invention is shown in FIGS. 1, 2, and 3A through 3C. A manually operated version, generally 100, of the knife is illustrated in FIGS. 4A through 4C, and an assisted-opening version, generally 200, is shown in FIGS. 5A through 5C.

Turning to the automatic version 10, FIGS. 1 and 2 illustrates knife 10 having a blade member, or blade, 14 in a retracted position, such position also being referred to herein as a "closed" or "folded" position. It is to be understood that as used herein the terms "blade" or "blade member" include an actual cutting blade or tool or a member which holds a tool, cutting blade, or cutting member, which could be the case if replaceable or interchangeable tools, blades, or cutting members are used.

Blade member 14, when in the retracted position is received within a blade cavity 16 provided in a knife handle, generally 18. Knife handle 18 can be constructed of polymer, wood, metal, plastic, glass, stone, bone, etc. In one preferred embodiment, knife handle 18 is constructed of a glass-filled nylon or acrylonitrile butadiene styrene (ABS), although it is to be understood that knife handle 18 is not limited constitution using such material.

Blade 14 is pivotally connected to knife handle 18 through use of male and female pivot members 20, 22, respectively, such as are shown in FIG. 2. Blade 14 is also shown in its retracted position in FIG. 3A, and FIG. 3B shows blade 14 pivoted to an intermediate position between the retracted position and extended position such as shown in FIG. 3C.

A combination blade lock and blade actuator, generally 26, is pivotally connected to the back portion, generally 28, of knife 10. As shown in FIG. 2, actuator 26 includes a forward engagement portion 30 which is configured for engagement with two different portions of blade 14. When blade 14 is in the retracted position, engagement portion 30 engages with blade retainer notch 32 defined in the tang portion 34 of blade 14. The engagement relationship between engagement portion 30 and retainer notch 32 is illustrated in FIG. 3A. As shown in FIG. 3C, when blade 14 is in the extended position, engagement portion 30 of actuator 26 engages with a blade lock notch 36, also defined in tang 34, and in one preferred embodiment, blade lock notch 36 is generally diametrically opposed from retainer lock notch 32.

In the automatic version 10 of the present invention, retainer notch 32 of blade 14 includes an engagement surface, upstanding tab, projection, ridge, stop member, or the like, generally 38, for engaging the front 40 of engagement portion 30 when blade 14 is in the retracted position. As used herein, the term "sear," generally 42, is meant to include each of such foregoing structures 38, either singularly, or in combination. The cooperation between stop 40 of engagement portion 30 and the sear 42 operates to maintain blade 14 in the closed position, since, in the automatic version 10, blade 14 is subjected to the force of force producing means may exert spring pressure, or the pressure of some other device, such as a pneumatic or hydraulic piston/cylinder arrangement, opposing magnet arrangement, or other suitable force producing means (none of which are shown).

In one preferred embodiment of knife 10, such force producing means include a spring and cable combination, generally 44. Combination 44 includes a coil spring 46 and a cable 48 connected thereto. Coil spring 46 is at one end connected to a retaining pin, or post 50, provided in the knife handle 18, and at the other end to a first end 48*a* of cable 48. The second end 48*b* of cable 48 is connected to a pin 52 which is provided in tang 34. It should be understood here that as used herein, "cable" refers to an elongated flexible member, which could be a braided or stranded metal (such as steel) cable, rope, line, chain, wire, cord, string, strand, length of plastic or polymer, a metallic or plastic band, etc. (none shown), although in one preferred embodiment, cable 48 is braided steel cable.

Pin 52 provided in tang 34 is configured to generally warp about the axis of rotation of blade 14, as blade 14 pivots between the open position and the closed position. Cable 48 passes within a circumferentially extending groove 56 provided in a cable slide member, or, pulley 58 pressed into opening 60 of tang 34. Note from FIG. 3A that when blade 14 is in the closed position, cable 48 is wrapped around pulley 58, and is in contact with groove 56 of pulley 58 over generally half of the circumferential dimension of pulley 58. Note also from FIG. 3A how spring 46 is shown to be in significant tension, evidencing the force being applied on pin 52, and in turn, on blade 14 caused by spring 46, the force of which is turned approximately 180 degrees by virtue of cable 48 wrapping around pulley 58. As noted above, the interaction of stop 40 of engagement portion 30 of actuator 26 with sear 42 maintains blade 14 in the retracted position.

Actuator 26 is pivotally attached to the handle 18, in one preferred embodiment, by a shaft 61 passing through a pivot arm 62 of actuator 26, shaft 61 being received in openings 64 of handle 18, and such pivot arm 62 being received within a recess 66 of handle 18.

Actuator 26 includes a tab 68 extending rearwardly of pivot arm 62, tab 68 being receivable in recess 66 upon depression of tab 68. Disposed between a floor 72 of recess 66 and the underside 68*a* (FIG. 3A) of tab 68, is a coil spring 74, which forces tab 68 upwardly, and, accordingly, engagement portion 30 towards engagement with retainer notch 32, locking notch 36, or the curved profile 34*a* of tang 34 therebetween.

A recess 76 is provided on each side of handle 18 (only one being shown) to allow the user to gain purchase with his or her finger or thumb with the underside of actuator 26 in order to selectively lift actuator 26 such that the forward portion 30 thereof is lifted out of engagement with tang 34 of the blade 14. For example, should blade 14 be in the closed position, as shown in FIG. 3A, the lifting of actuator 26 by sufficient amount will cause the stop 40 of the forward portion 30 of actuator 26 to become disengaged with sear 42. Once this disengagement occurs, there is no longer no restraint placed on the retraction of coil spring 46, which in turn causes coil spring 46 to move from its extended, tensioned, position shown in FIG. 3A to its more relaxed position, such as shown in FIG. 3C. Meanwhile, as spring 46 assumes its more relaxed position, cable 48 is pulled rearwardly, in the direction shown by arrow A in FIGS. 3B and 3C, and this in turn causes cable 48 to pull on pin 52 in blade 14 about pulley 58, thereby pulling blade 14 from the retracted position to the fully extended position, as shown in FIG. 3C.

In the intermediate position of blade 14 between the closed and retracted positions, the forward engagement portion 30 of actuator 26 rides upon the curved profile 34*a* of tang 34 between retainer notch 32 and locking notch 36. Once blade 14 is in the fully opened, or extended, position shown in FIG. 3, the engagement portion 30 of actuator 26 becomes seated in locking notch 36 to thereby lock blade 14 in the open configuration. In order to thereafter pivot blade 14 towards the closed position, the actuator 26 must again be lifted in the direction as shown by arrow B in FIG. 3B, or tab 68 depressed in the direction of arrow C, as shown in FIG. 3B in order to disengage engagement portion 30 with lock notch 36 and to thereby allow the user to manually pivot the blade back to the closed position, which, of course, will be done against the force of coil spring 46 acting through cable 48.

As shown in FIGS. 1 and 2, actuator 26 preferable extends the full width of the blade handle 18, i.e., from one side of the handle 18 to the other side of handle 18. Actuator 26 can thus be accessed by either side of handle 18 in order to raise actuator 26 for automatic opening of the blade from the closed position, or for moving the blade to the closed position from the open position. This arrangement allows knife 10 to have ambidextrous operation. Although not required, actuator 26 as shown in the drawings includes open frame portion 80 which receives a projection 82 provided in handle 18, the open frame and projection being generally flush with one another when blade 14 is in either the open or closed positions, for example, as shown in FIG. 1 wherein blade 14 is in the closed position.

Knife 10 also may include a clip 84 connected to handle 18 with screws 85 and with the male pivot member 20, through cooperation with female pivot member 22.

Knife handle 18 in a preferred embodiment includes a first handle portion 87 which defines a recess 88 for receipt of spring 46, cable 48, pulley 58, and cable pin 50 and may also include a liner 89 adjacent handle portion 87. A second handle portion 90 may also then be attached to the first handle portion 87, with liner 89 sandwiched therebetween. Handle portions 87, 90 can be held together with cooperating male and female threaded fasteners 91*a* and 91*b*, and also with the male and female pivot members 20, 22 discussed above.

Turning to FIGS. 4A through 4C, the manual version 100 of the convertible knife constructed in accordance with the present invention is illustrated. In version 100, blade 114, which may include a blade knob or tab, generally 102, fixedly attached thereto, is manually moved from the closed position, as shown in FIG. 4A, through an intermediate position, as shown in FIG. 4B, to an open, or extended position, shown in FIG. 4C. Blade 114 is held in the closed position through interaction of engagement portion 30 of actuator 26 with retainer notch 32 of blade 114, similarly as discussed above with regards to knife 10 discussed above. In this arrangement, however, coil spring, 46, cable 48, pulley 58, blade pin 52, and post 50 (FIG. 3B) are not necessary, and thus not included in knife 100.

Thus, if blade 114 is to be moved from the closed position to the open position, actuator 26 is lifted, such that engagement portion 30 no longer engages with retainer notch 32 or sear 42, and blade 114 is manually pivoted towards the open position, with the downward pressure of engagement portion on curved profile 134*a* of tang 134 providing some resistance such that blade 114 does not simply fall or "flop" out of handle 18 once engagement portion of actuator 26 is lifted. Once blade 114 reaches the open position, the engagement portion registers with the lock notch 32 to lock blade 114 in the extended position. As discussed above with regards to knife 10, actuator 26 is lifted such that engagement portion 30 no longer registers with lock notch 36 in order to allow blade 114 to be pivoted back to the closed position. Through use of tab 68, movement of blade 114 from the closed position to the open position and back to the closed position is facilitated.

FIGS. 5A through 5C illustrated knife 200, wherein blade 214 is provided with assisted opening. As discussed above, assisted opening knives generally require the user to move the blade from the closed position towards the retracted position through a predetermined distance, typically through an arc of predetermined length, at which time force is applied to the blade either by a spring, elastic member, pneumatic or hydraulic piston/cylinder arrangement, opposed magnets, or some other force providing means, in order to move the blade through the remainder of its travel to the open, or extended, position.

Regarding knife 200, when blade 214 is in the extended position, blade 214 is automatically locked in such extended position with actuator 26 in a manner as discussed above in regards to knives 10 and 100. Thus in each of the three knives, 10, 100, and 200, actuator 26 operates in a similar manner to lock the knife's blade in the extended position. However, each of the knives 10, 100, and 200 differ in the manner in which the blade is moved from the closed to the open position. In knife 200, spring 46 and cable 48*a* are used, with one end of spring 46 being connected to post 50 attached to handle 18, and with one end of cable 48 being attached to pin 52*a* carried in the tang 234 of blade 214. The respective other ends of spring 46 and cable 48*a* are connected to one another. Knives 10 and 200 differ, however, in several respects. First, blade 214 lacks the sear 42 provided on blade 14 of knife 10, and, incidentally, also on blade 114 of knife 100. The removal of sear 42 eliminates the need to lift actuator 28 in order to initiate movement of blade 214 from the closed position towards the open position. In knife 200, the user initiates such movement by manually moving blade 214 away from the closed position, such as by using tab 102 provided on blade 214.

Figure 6A:
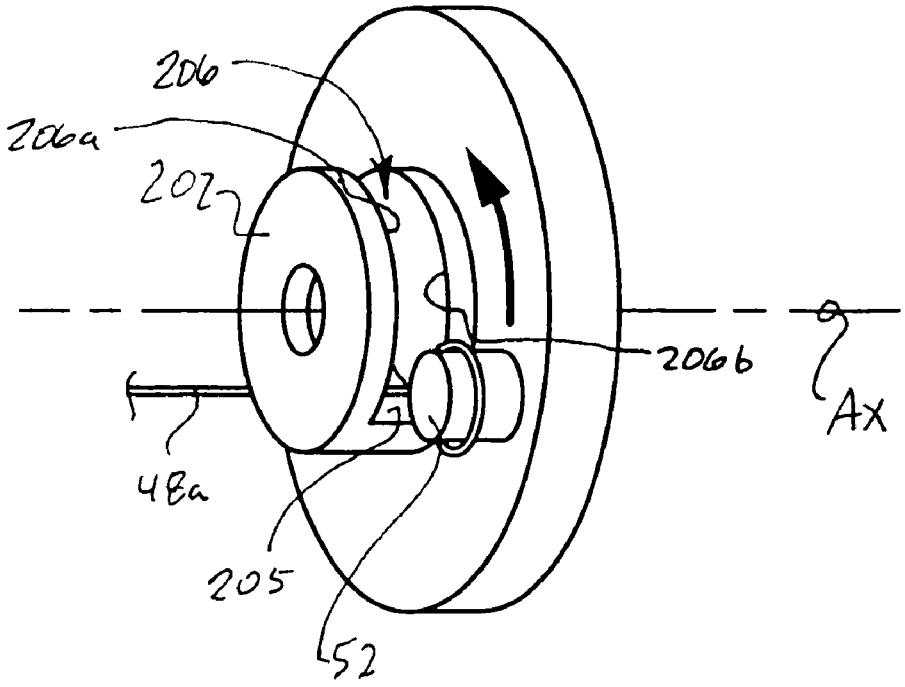
FIG. 6A is a partial perspective view of a guide member carried in the knife shown in FIG. 5A, the guide member being in a position it assumes when the blade is in the retracted position.
Figure 6B:
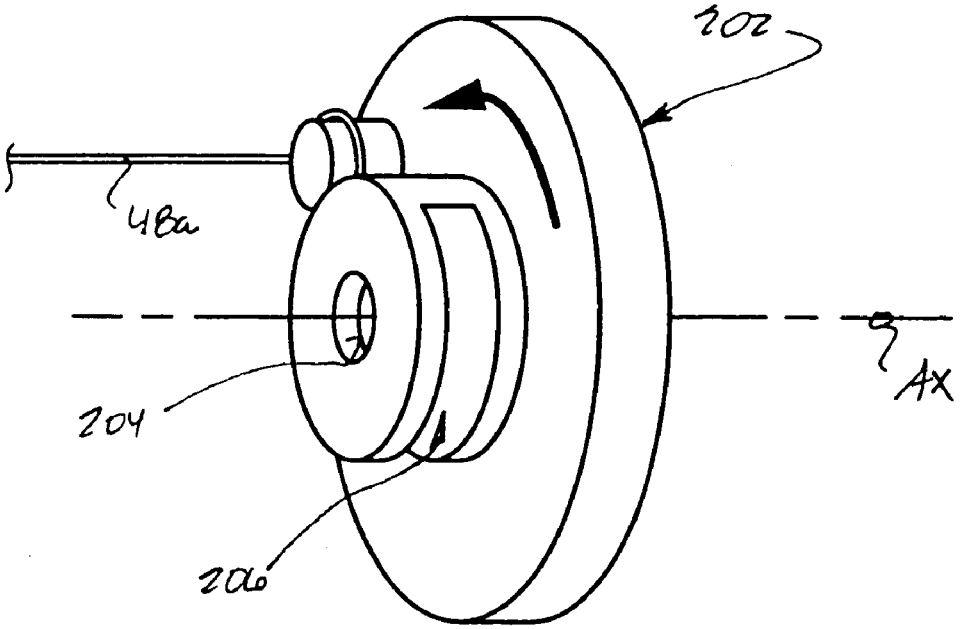
FIG. 6B is a perspective view of the guide member shown in FIG. 6A, in a position it assumes when the blade of the knife shown in FIG. 5A is in an extended position.

Another difference between knife 10 and 200 is that knife 200 does not include the pulley 58 with the circumferential groove for carrying cable 48. Instead, knife 200 includes a fork, or yoke, 202, as shown in FIGS. 6A and 6B, connected to blade 214. Yoke 202 includes a hole 204 which is coaxial with the pivot axis of blade 214.

As shown in FIG. 5A, when blade 214 is in the closed position, spring 46 is in tension, and cable 48*a* passes below the pivot axis of blade 214, adjacent the floor 205 of yoke 202. This arrangement serves to maintain blade 214 in the closed position because the line of force of cable 46 is below the pivot axis AX of the blade. However, as blade 214 is moved from the closed position towards the open position, pin 52*a*, which is at a different position on tang 234 than is the case with knife 10, revolves about the pivot axis AX of blade 214, and once pin 52*a* passes above, as shown in FIG. 6A, the pivot axis AX of blade 214, the line of force is such that blade 214 is now urged to pivot towards the open position under the force of spring 46, as shown in FIG. 5B. Once blade 214 has reached the extended position, and has become automatically locked there in a manner as discussed above using actuator 28, spring 46 is in a more relaxed state.

As shown in FIGS. 6A and 6B, yoke member 202 provides a guide for cable 48*a* by virtue of a cable channel 206 being formed between walls 206*a* and 206*b* of yoke member 202. However, yoke member 202 also allows for cable 48*a* to pass below the pivot axis of blade 214, when blade 214 is in the closed position, as shown in FIG. 6A, in order to urge blade 214 towards the closed position after blade 214 has been pivoted to a predetermined position as blade 214 is being closed.

It is to be noted that in each of the forgoing knives, 10, 100, and 200, essentially the same handle 18, clip 84, liner 89, and blade lock/actuator 28, arrangement can be used. This feature may provide for reduced production and assembly costs and complexity in the production of three different types of knives. For example, the components used to make knife 200 are very similar to that of knife 10, except that the blade 214 of knife 200 preferably would lack a sear, and knife 200 would include, instead of pulley 58, a yoke member 202. If desired, production of assisted opening knives can be readily converted to production of automatic opening knives with a minimal change in parts. Similarly, production of automatic knives could be readily converted to assisted opening knives. Also, if desired, production of assisted or automatic opening knives could be changed to manually opened knives with a relatively small amount of changes.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A method of converting an automatic opening knife to an assisted opening knife, comprising:

providing a handle having a back portion, a first exterior side portion, and a second exterior side portion generally opposite said first exterior side portion, and a blade cavity having a blade cavity opening;

providing a blade pivotally connected to said handle for pivoting about a pivot axis between an extended position and a retracted position with respect to said handle;

providing a sear on said blade;

providing an engagement member configured for upward movement with respect to said back portion of said handle and for selectively engaging said sear, said engagement member extending generally from said first exterior side portion of said handle to said second exterior side portion of said handle and configured for engaging said sear upon said blade being in said retracted position;

providing a cable connected to the blade;

providing a spring;

connecting said cable to said spring and said spring to the handle such that said cable biases the blade towards said extended position;

configuring said blade to automatically pivot from said retracted position to said extended position upon said engagement member being lifted upwardly from said back portion of said handle and disengaged with said sear; and after said configuring of said blade, removing said sear and providing a guide member generally coaxial with the pivot axis of the blade for guiding said cable to a position between the pivot axis of the blade and the blade cavity opening of the handle upon the blade being in the retracted position and to a position between the pivot axis of the blade and the back portion of the handle upon the blade being in the extended position.

2. A method of converting an assisted opening knife to an automatic opening knife, comprising:

providing a handle having a back portion, a first exterior side portion, and a second exterior side portion generally opposite said first exterior side portion, and a blade cavity having a blade cavity opening;

providing a blade pivotally connected to said handle for pivoting about a pivot axis between an extended position and a retracted position with respect to said handle;

providing an engagement member configured for upward movement with respect to said back portion of said handle, said engagement member extending generally from said first exterior side portion of said handle to said second exterior side portion of said handle and configured for automatically locking said blade upon said blade being in said extended position;

providing a cable connected to the blade providing a spring for biasing said blade towards said extended position;

connecting said spring to said cable and to said handle;

providing a guide member generally coaxial with the pivot axis of the blade for guiding said cable to a position between the pivot axis of the blade and the blade cavity opening of the handle upon the blade being in the retracted position and to a position between the pivot axis of the blade and the back portion of the handle upon the blade being in the extended position;

configuring said blade to automatically pivot to said extended position upon pivoting of said blade a predetermined distance from said retracted position towards said extended position; and after said configuring of said blade, removing said guide member, and providing a sear on said blade for engagement by said engagement member upon said blade being in said retracted position; and providing a cable slide member for directing said cable such that said blade automatically pivots from said retracted position to said extended position upon said engagement member being lifted upwardly from said back portion of said handle and disengaged with said sear.

* * * * *